US008210766B2

(12) United States Patent
Schermer et al.

(10) Patent No.: US 8,210,766 B2
(45) Date of Patent: Jul. 3, 2012

(54) OPENING CYLINDER WITH CLIP CONNECTION

(75) Inventors: Josef Schermer, Bergheim-Unterstall (DE); Edmund Schuller, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 820 days.

(21) Appl. No.: 12/187,688

(22) Filed: Aug. 7, 2008

(65) Prior Publication Data

US 2009/0038576 A1 Feb. 12, 2009

(51) Int. Cl.
*F16B 21/00* (2006.01)
*D01G 15/12* (2006.01)

(52) U.S. Cl. ..... 403/329; 19/112

(58) Field of Classification Search ..... 19/112; 57/408; 403/329
See application file for complete search history.

(56) References Cited

U.S. PATENT DOCUMENTS

| | | | | | |
|---|---|---|---|---|---|
| 4,296,527 | A | * | 10/1981 | Eadie | 19/112 |
| 4,300,265 | A | * | 11/1981 | Heinen | 19/112 |
| 4,574,583 | A | * | 3/1986 | Stahlecker et al. | 57/408 |
| 4,679,390 | A | * | 7/1987 | Stewart | 57/408 |
| 5,794,311 | A | * | 8/1998 | Schuller et al. | 19/112 |
| 5,899,057 | A | * | 5/1999 | Schuller et al. | 57/408 |
| 5,943,854 | A | * | 8/1999 | Schuller et al. | 57/408 |
| 6,006,511 | A | * | 12/1999 | Hofmann et al. | 57/408 |
| 6,843,437 | B2 | * | 1/2005 | Pohn et al. | 241/294 |
| 2004/0016222 | A1 | | 1/2004 | Schuller et al. | |
| 2004/0218843 | A1 | | 11/2004 | Jennes et al. | |
| 2008/0131223 | A1 | | 6/2008 | Jauch | |

FOREIGN PATENT DOCUMENTS

| | | | | |
|---|---|---|---|---|
| DE | 10260507 | A1 | * | 7/2004 |
| DE | 20 2006 000 786 | U1 | | 5/2006 |
| EP | 747517 | A1 | * | 12/1996 |
| EP | 849382 | A2 | * | 6/1998 |
| EP | 1273686 | A2 | * | 1/2003 |
| EP | 1344853 | B1 | | 1/2003 |
| EP | 1344853 | A1 | * | 9/2003 |
| EP | 1344854 | A2 | * | 9/2003 |

OTHER PUBLICATIONS

German Search Report for DE 10 2007 037 2290, Nov. 12, 2007.
European Patent Office Search Report, Apr. 7, 2011.

* cited by examiner

*Primary Examiner* — Victor MacArthur
(74) *Attorney, Agent, or Firm* — Dority & Manning, P.A.

(57) ABSTRACT

An opening cylinder for an open-end spinning device has a core piece over which the opening cylinder is fastened on a drive shaft and a tooth-set carrier supporting the tooth-set. The tooth set-carrier is fastened to the core piece by a clip connection in the axial direction. Additionally, the opening cylinder has a device for the form-fitting connection of the core piece and tooth-set carrier in the circumferential direction with a projecting part and a corresponding recess. The tooth-set carrier is fastened with a clip connection to a core piece of the opening cylinder in the axial direction. The tooth-set carrier has a projecting part for the form-fitting connection with the core piece in circumferential direction.

18 Claims, 5 Drawing Sheets

OPENING CYLINDER WITH CLIP CONNECTION

FIELD OF THE INVENTION

The present invention relates to an opening cylinder for an open-end spinning device having a core piece over which the opening cylinder is attached to a drive shaft and to a tooth set carrier. The tooth set carrier is fastened to the core piece by a clip connection in the axial direction. In addition, the opening cylinder includes a device for the form-fitting connection of the core piece and tooth set carrier in the circumferential direction. The form-fitting connection device may include a projecting part and a corresponding recess.

BACKGROUND OF THE INVENTION

EP 1 273 686 A2 describes an opening cylinder with a re-detachable connecting device located between the core piece and the drive shaft so that the opening cylinder can be replaced easily and quickly and so the opening cylinder does not have to be completely disassembled. According to one embodiment, a clip- or latch-like connecting device is located between the tooth-set carrier and the core piece. However, EP 1 273 686 does not disclose the radial catching of the tooth set carrier by the core piece.

DE 102 36 992 A1 describes an opening cylinder for an open-end spinning device with a tooth-set carrier and a core piece. The core piece and the tooth-set carrier create a form-fitting connection with each other in the circumferential direction. As a result, the torque transfer from the core piece to the tooth-set carrier does not depend exclusively on axial holding forces. The publication therefore discloses adding a projecting part to the core piece to create the form-fitting connection in the circumferential direction with a corresponding recess of the tooth-set carrier. Clamping screws or a clip connection ensure the axial union between the core piece and the tooth-set carrier.

SUMMARY OF THE INVENTION

It is an object of the present invention to provide an opening cylinder, a tooth-set carrier for an opening cylinder, and a core piece for an opening cylinder that simplifies the assembly and disassembly process of the tooth-set carrier and provides a secure torque transfer from the core piece to the tooth-set carrier. Additional objects and advantages of the invention will be set forth in the following description, or may be apparent from the description, or may be learned through practice of the invention.

A summary of exemplary embodiments of the present invention will be set forth here. Using the description provided herein, one skilled in the art will understand that additional exemplary embodiments are within the scope of the present invention.

One exemplary embodiment of the present invention provides an opening cylinder for an open-end spinning device with a core piece over which the opening cylinder is attached to a drive shaft and to a tooth-set carrier. The tooth-set carrier is fastened to the core piece with a clip connection in the axial direction and has a device for the form-fitting connection of the core piece and the tooth-set carrier in the circumferential direction. The device for the form-fitting connection may include a projecting part and a recess.

In one exemplary embodiment of the present invention, the projecting part also creates a catch shoulder for the clip connection. The projecting part may extend longitudinally in the axial direction of the tooth-set carrier or of the core piece. If the projecting part is located on the tooth-set carrier, then the tooth-set carrier can be manufactured very easily. The mounting and dismounting of the tooth-set carrier on the core piece becomes particularly easy because the catch shoulder or clip element of the clip connection can also be automatically and correctly positioned in relation to each other once the projecting part is correctly positioned with respect to the recess. At the same time, the projecting part provides a safe radial catch. Although the projected part creates a catch shoulder for the clip connection, the radial catch provided by the projecting part functions independently from the clip connection.

In one advantageous embodiment, the projecting part and the corresponding recess enable a torque transfer in both circumferential directions. As a result of this, if laps are formed, their disentangling is possible by reversing the rotation of the opening cylinder. Preferably, it is possible to transfer the force with almost no backlash.

In another advantageous embodiment, the clip element of the clip connection is designed elastically so that it can bend in the radial direction to lock with the catching shoulder of the projecting part. The locking and loosening of the clip connection in the axial direction takes place through the elastic bending of the clip element in the radial direction. Thus, the clip connection works in both directions independently from the radial catching of the projecting part.

In another advantageous embodiment, the projecting part is arranged in a cylindrical inner area of the tooth-set carrier and the recess is arranged on the core piece. This embodiment enables the convenient manufacturing of both the tooth-set carrier and the core piece because the easily-manufactured catch shoulder is placed on the tooth-set carrier while the harder to manufacture clip element is placed on the core piece, which has more diverse manufacturing possibilities. In an alternate embodiment it is also possible to locate the projecting part on the core piece and the recess on the tooth-set carrier.

According to another exemplary embodiment of the present invention, the core piece and the clip element are formed as one single piece from a plastic material. As a result of this design, the clip element is automatically positioned in the right place, thus facilitating the mounting of the tooth-set carrier. In addition, such a core piece can be manufactured economically.

In another advantageous embodiment, the tooth-set carrier has several projecting parts evenly distributed over the periphery of the tooth-set carrier. As a result, several clip connections can be utilized to increase the axial holding forces while simultaneously distributing radial forces more evenly. In addition, the form-fitting or clip connection has an impact prevention function.

In another advantageous embodiment, the tooth-set carrier has six projecting parts evenly distributed over the periphery. This arrangement allows for the easy mounting of the tooth-set carrier on the core piece because the tooth-set carrier can be mounted on the core piece every 60 degrees. Accordingly, once the tooth-set carrier has been placed on the core piece, the tooth set carrier must be rotated no more than 30 degrees for the projecting part and the recess to lock with one another, thus enabling the clip element and the catch shoulder to interlock as well.

In another advantageous embodiment, the catch shoulder is placed on an end part lying opposite to a front part of the tooth-set carrier. This arrangement greatly facilitates the manufacturing of the catch shoulder because it can take place, for example, by torsional processing of the tooth-set carrier. In addition, the catch shoulder is easily accessible from the end part.

To simplify the mounting and centering of the tooth-set carrier on the core piece, another exemplary embodiment of the tooth-set carrier has a reduced diameter on the end part opposite the front part for preliminary centering purposes. Although only a small elevation of for example 2-3 mm is necessary, this design facilitates the placement of the tooth-set carrier on the core piece because the position of the projecting parts and recesses does not have to be first taken into account. A simple turning with slight axial pressure can subsequently engage the projecting parts with the recesses.

In another advantageous embodiment, a clip element of the clip connection is arranged on the core piece. The clip element, which is harder to manufacture than the catch shoulder of the clip connection, can be more economically produced with this arrangement.

The clip element is preferably placed in a recess of the cylindrical outer area of the core piece. As a result, the clip element can be attached to the core piece in an elastic way and a high retention force is achieved.

According to a particularly advantageous embodiment of the present invention, the relief for the clip element is also the recess of the form-fitting connection. In this embodiment, the recess or relief has the same width as the projecting part of the tooth-set carrier. In this embodiment, it is advantageous if several clip elements are uniformly arranged along the periphery of the core piece because it increases the axial retention force and reduces loads caused by impacts. In one advantageous embodiment, three clip elements are uniformly arranged on the periphery of the core piece.

In another embodiment of the present invention, the core piece has three recesses that create the form-fitting connection in the circumferential direction. The clip elements are arranged in each of the three recess. In this embodiment, the clip connection on the core piece is spatially separated from the radial catching. It is still nonetheless advantageously possible to develop the projecting parts on the tooth-set carrier as one single unit with catch shoulders for the clip elements. This embodiment has the advantage that the clip elements can be manufactured regardless of the measurements of the projecting parts on the tooth-set carrier, which can nevertheless have six simple, identical projecting parts with catch shoulders.

In an additional advantageous embodiment, the clip elements are formed as one single piece with the core piece. In this embodiment, the clip elements may be directly injection molded on the core piece if the core piece is a plastic injection molded part. In this embodiment, manufacturing is particularly easy and economical.

According to another embodiment of the present invention, the clip element may be a leaf spring fastened to the core piece or the tooth-set though welding, screwing, riveting, caulking or the like. It is also possible to press the leaf spring onto the core piece or tooth-set carrier. Other embodiments in which a clip element is manufactured separately from the core piece or tooth-set carrier are possible as well.

For fastening the leaf spring to the core piece or tooth-set carrier it is also advantageous for the leaf spring to have a clamp-shaped element that can easily be formed by the bent end piece of the leaf spring. After the leaf spring is mounted, the bent end piece interlocks to a wall of the core piece or tooth-set carrier. However, the clamping element can also be made of a window punched out of the leaf spring and bent in the direction of the wall.

In another exemplary embodiment, the clamping element has a wire edge so it can give the grip extra support. If the leaf spring is manufactured from a band material through punching, such an edge is already present and the leaf spring only has to be bent proportionately more.

According to another advantageous embodiment of the present invention, the clip element has an end piece that interacts with the catch shoulder to increase the clip connection retention forces when there is rotation. The clip element may have a relatively wide shape so that the end piece of the clip element has a larger mass. The centrifugal force created by rotation presses the end piece of the clip element outwards towards the inclined catch shoulder of the clip connection, thus increasing the axial retention forces.

In another particularly advantageous embodiment, the core piece is made of a plastic material, preferably in the form of a plastic injection molded part. Plastic injection molded parts can be produced with consistent high quality, and more complex shapes can easily be produced. Furthermore, it is more economical to manufacture the core piece from a plastic part than from a metal part (such as aluminum). It would be preferable if the plastic material could conduct electricity because it avoids the electrostatic charges of the release cylinder which can lead to unfavorable fiber adherences.

According to yet another beneficial embodiment of the present invention, a metallic seat (especially of aluminum or brass) is poured into the core piece. This makes it possible to fasten the core piece in a known way by pressing the core piece on the drive shaft, even if the core piece is made from a less solid plastic material. However, the core piece can also be made entirely of a plastic material, which would also allow a compression connection.

In another advantageous embodiment of the present invention, the core piece is manufactured in such a way that its front part is oriented toward the interior of the open-end spinning device in its mounted state. The tooth-set carrier, which is subject to wear and tear, must be replaced more often than the core piece. In this embodiment, the tooth-set carrier can be easily pulled out of the core piece via the clip connection without having to detach the entire opening cylinder together with the drive shaft from the spinning device.

In another exemplary embodiment, it is possible to arrange the core piece on the shaft in such a way so that its front part is oriented toward the exterior of the open-end spinning machine. In this case, the tooth-set carrier can only be replaced if the opening cylinder is detached from the spinning device together with the drive shaft. However, another embodiment could also allow the detachment of the core piece together with the tooth-set carrier from the drive shaft.

If the front part of the core piece is oriented to the exterior, it would be advantageous if this outwards-pointing front part included a detachable lid. This embodiment allows the core piece to be light weight and thin-walled. The lid seals the hollow spaces or grooves of the core piece, thus preventing unfavorable air currents to flow through the grooves. In this embodiment, the elaborate shapes of the core piece—needed for sealing it off against the open-end spinning device—could be manufactured economically and with thin walls.

For cleaning purposes, the lid may be fastened to the core piece in a detachable manner. The lid may also have information about the currently used tooth set imprinted on it. When the tooth set is changed, the lid is also replaced with the corresponding lid of the new tooth set.

According to yet another embodiment of the present invention, the lid has an opening though which a dismounting tool for removing the opening cylinder can be introduced. Since the opening cylinder and the drive shaft must be taken out of the spinning device, the retention forces that keep the lid on the core piece must be strong enough to allow this dismounting. Such large retention forces, however, go against the desire to have an easily detachable lid that can be easily replaced according to the tooth set.

Therefore, it would be practical to assign an easily replaceable identification carrier to the lid which provides information about the tooth set. The identification carrier may only be inserted into the lid. The currently used tooth set could thus be easily identified from outside because of the identification carrier.

In yet another exemplary embodiment of the present invention, the core piece has grooves running in an axial direction, accessible for cleaning purposes from both axial directions when the core piece is mounted on the shaft. Such grooves are known in the art. Such grooves allow the core piece to be manufactured very easily, but they also cause problems due to dirt accumulation in the groove (especially fiber material getting into the interior of the opening cylinder or the core piece). Therefore, the exemplary embodiments of the present invention are executed in a manner to allow the grooves to be cleaned from both axial directions even if the core piece is mounted onto the shaft. Consequently, the grooves extend through the entire core piece and are covered by the lid and the tooth-set carrier during operation.

The tooth-set carrier according to exemplary embodiments of the present invention is preferably made of aluminum material, especially as an extruded part. It is also possible, however, to make the tooth-set carrier from aluminum as a die cast part. At the same time, the tooth-set carrier can also be manufactured as a forged piece made from aluminum or brass.

In yet another embodiment of the present invention, the catch shoulder of the clip connection is formed as a recess in the projecting part. It is advantageous if the catch shoulder is made by the tooth-set carrier's rotating process.

In yet another embodiment, the tooth-set carrier has two parts, a tooth-set holder and a tooth-set ring. In this embodiment, a device for the radial catching of the tooth-set ring by the tooth-set carrier can be utilized and the tooth-set carrier can be economically manufactured from plastic material. In this embodiment, if the tooth-set carrier wears out, only the tooth-set ring is replaced. However, depending on the design, it is also possible for the tooth-set carrier to be made entirely of plastic.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE DRAWINGS

Figures 1, 6:
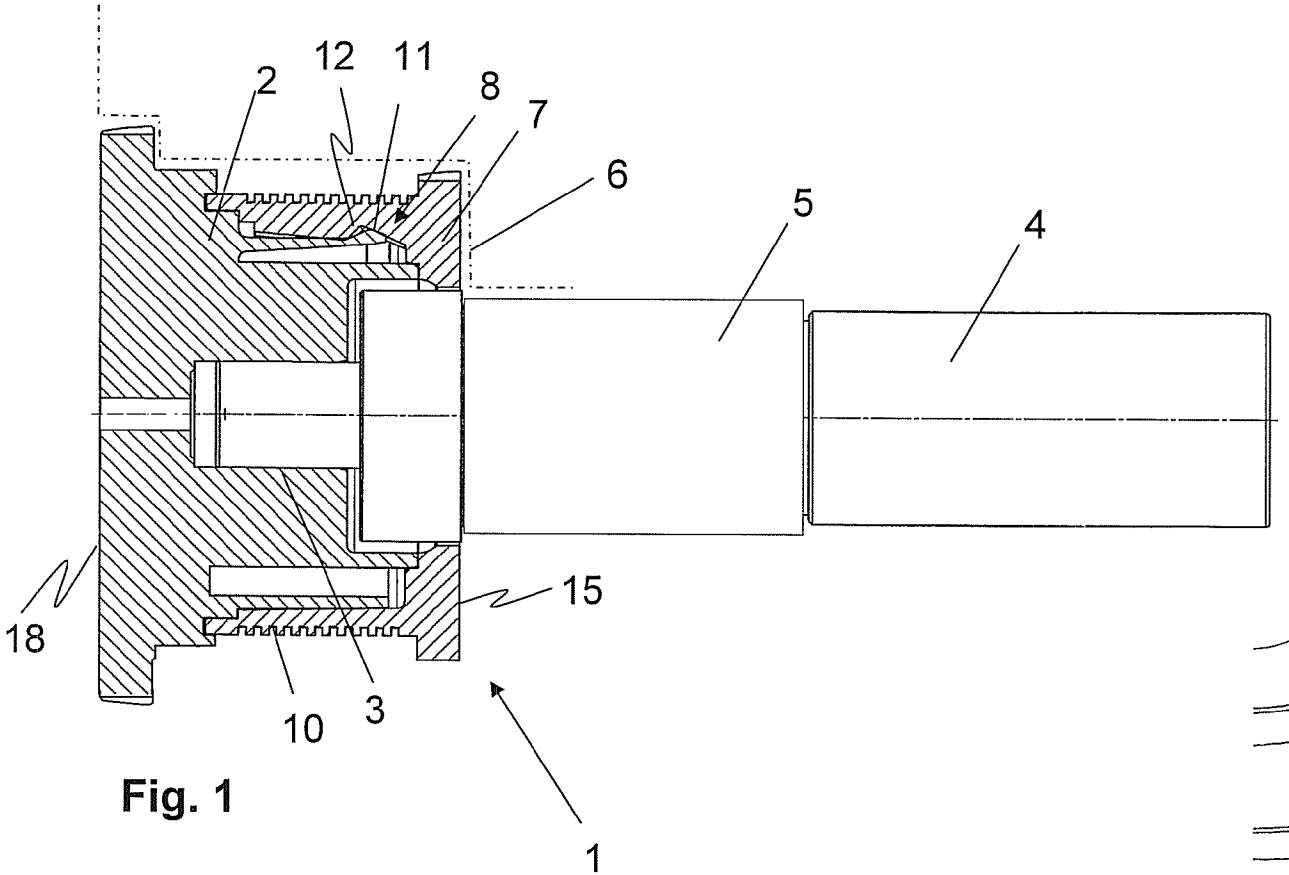
FIG. 1 depicts a sectional view of an opening cylinder and a tooth-set carrier that are united by a clip connection according to an exemplary embodiment of the present invention.
FIG. 6 depicts a detailed view of a clip connection of an opening cylinder according to an exemplary embodiment of the present invention.

Reference is now made to embodiments of the invention, examples of which are illustrated in the drawings.

FIG. 1 shows a sectional view of an opening cylinder 1 for an open-end spinning device 6. The opening cylinder 1 consist of a core piece 2, over which a press fit is fastened to a drive shaft 4 via a seat 3. The shaft 4 can be turned with a bearing 5 lodged in an open-end spinning device 6, indicated here only as a dash-dot line. The opening cylinder 1 also consists of a tooth-set carrier 7 fastened to the core piece 2 with a clip connection 8. The tooth-set carrier 7 has grooves 10 where a tooth-set wire can be attached.

Figure 7:
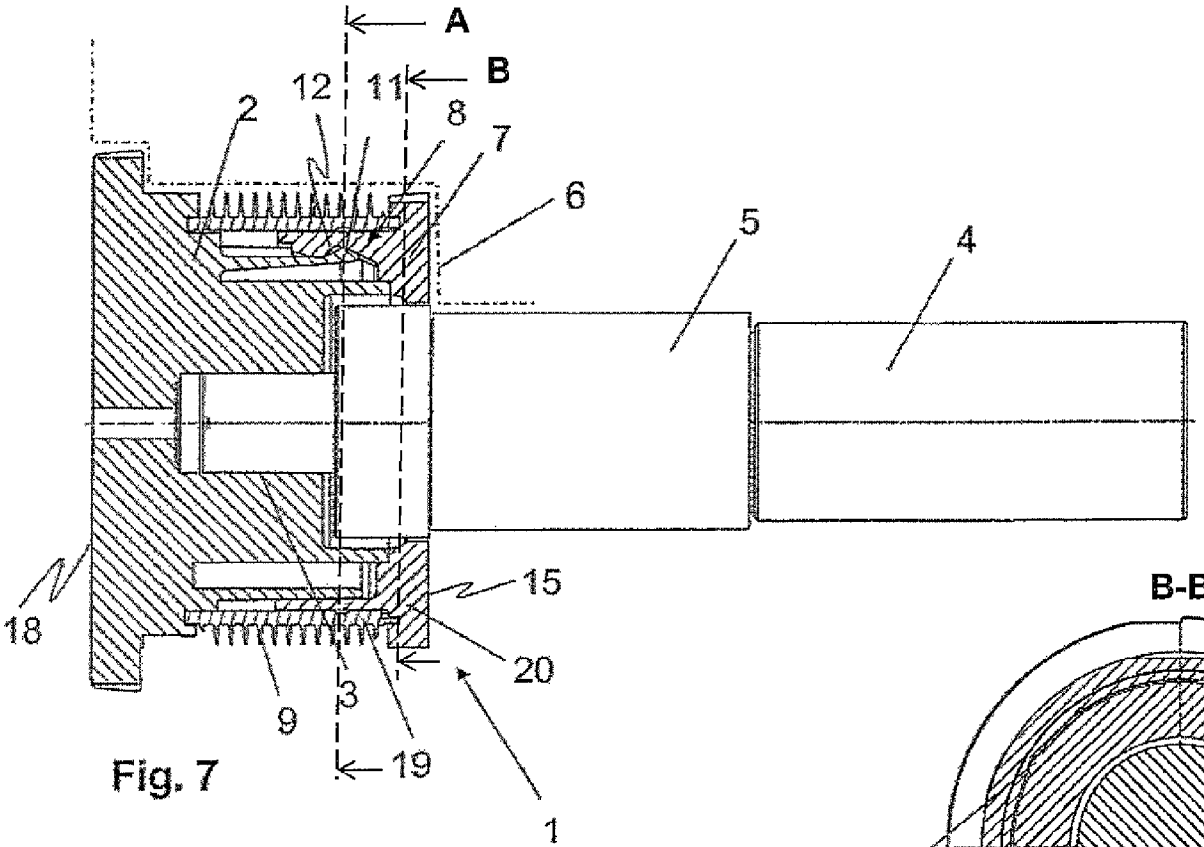
FIG. 7 depicts a longitudinal view of an opening cylinder according to an exemplary embodiment of the present invention with a two-part tooth-set carrier united by a clip connection.
Figure 8:
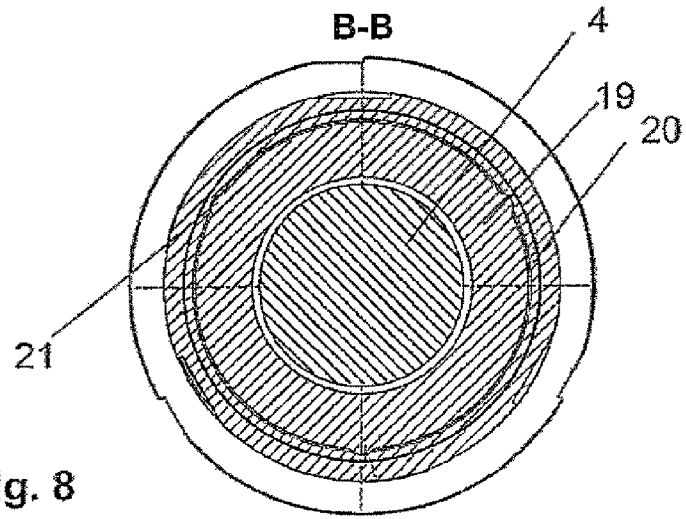
FIG. 8 depicts a cross section of the opening cylinder from FIG. 7.

In accordance with the exemplary embodiment shown in FIG. 1, the tooth-set carrier 7 is manufactured as one piece. However, it is also possible to manufacture the tooth-set 7 carrier as two pieces, the tooth-set holder 19 and the tooth-set ring 20, as shown in FIGS. 7 and 8. FIG. 1 does not show the tooth set 9 made of teeth or needles. The clip connection 8 consists of a clip element 11 and a catch shoulder 12. The clip element 11 and the catch shoulder 12 act together to fix the tooth-set carrier 7 to the core piece 2 in the axial direction.

Figure 4:
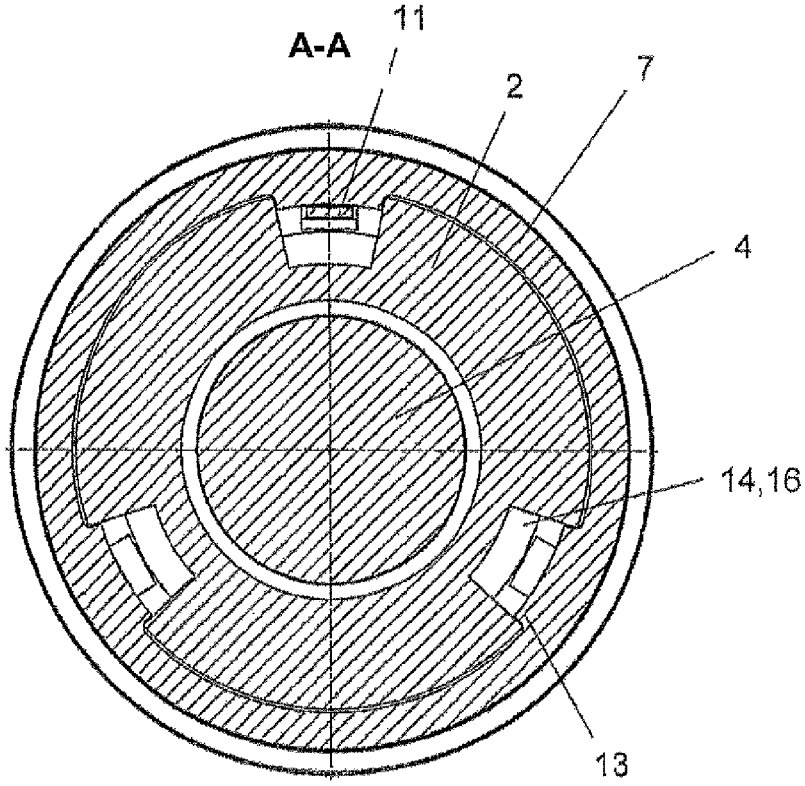
FIG. 4 depicts another sectional view of an opening cylinder with a tooth-set carrier according to an exemplary embodiment of the present invention.

In addition, this exemplary embodiment provides a device for the form-fitting connection of core piece 2 and tooth-set carrier 7 in the circumferential direction in order to allow the torque transfer from the core piece 2 to the tooth-set carrier 7. The form-fitting connection device comprises a projecting part 13 and a recess 14. The projecting part 12 and the recess 14 act together as shown in FIG. 4.

Figure 2:
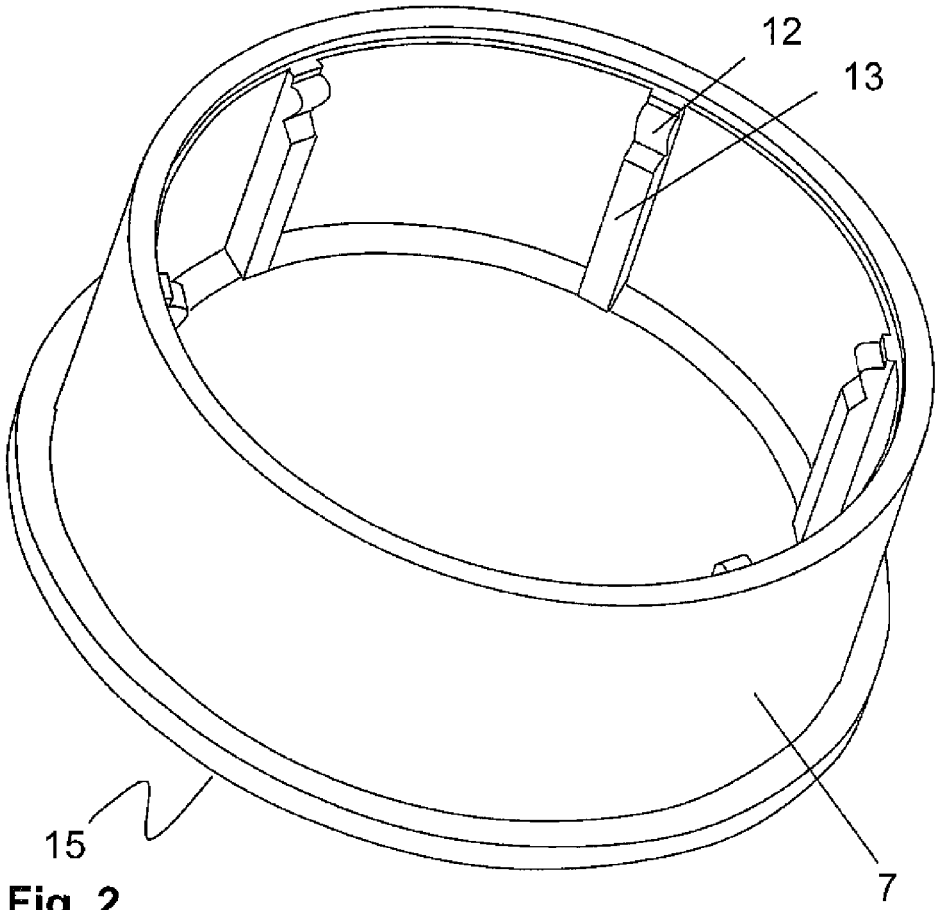
FIG. 2 depicts an exploded view of another embodiment of a tooth-set carrier according to the present invention.

FIG. 2 shows a tooth-set carrier 7 according to an exemplary embodiment of the present invention on which several projecting parts 13 are arranged on its cylindrical interior and act together with the corresponding recesses 14 (shown in FIG. 4) of the core piece 2 in the circumferential direction. According to this embodiment, the projecting part 13 also forms a catch shoulder 12 of the clip connection 8. The projecting parts 13 extend in the radial direction of the opening cylinder. Because the catch shoulder 12 is placed directly on the projecting part 13, the opening cylinder 2 can be mounted very easily. To accomplish this, only the projecting parts 13 have to be aligned with the recesses 14 of the core piece 2, so that the opening cylinder 2 can be subsequently mounted just by applying axial pressure. In this embodiment, the clip element 11, which is attached to the core piece 2, slides into the catch shoulder 12 of the tooth-set carrier 7.

The clip element 11 has been configured in this embodiment to bend elastically in the radial direction so that the catching or loosening with the catch shoulder 12 of the projecting part 13 takes place in the axial direction. This allows the clip connection 8 to work independently from the form-fitting connection in the circumferential direction of the projecting part 13 and the recess 14. The form-fitting connection in the circumferential direction has been designed in such a way that it allows a torque transfer in both circumferential directions of the opening cylinder 1. Despite this, the axial fastening of the opening cylinder 1 is not adversely affected. In case of lap formation, this embodiment permits the uncoiling of the laps, for example, by turning the opening cylinder 1 against its driving direction. The clip connection 8 remains unaffected by this.

In the exemplary embodiment of the present invention depicted in FIG. 2, six projecting parts 13 are uniformly distributed on the tooth-set carrier 7 over the periphery of the cylindrical interior. However, it is also possible to utilize only one or two projecting parts 13, each one acting together with a clip element 11 of the core piece 2. The use of several projecting parts 13 for the form-fitting connection in the circumferential direction prevents impacts and allows for the particularly reliable torque transfer from the core piece 2 to the tooth-set carrier 7.

To facilitate the mounting of the opening cylinder 1, the end piece opposite the front part 15 of the tooth-set carrier 7 may have a reduced diameter, shown only partially in FIG. 2. As a result of this reduced diameter, the tooth-set carrier 7 can be placed initially on the core piece 2 without regard the orientation of the projecting parts 13 and recesses 14. By the simple turning of the tooth-set carrier 7 and the application of slight pressure, the projecting parts 13 are finally aligned with the recesses 14 so that the tooth-set carrier 7 can be mounted in the axial direction. If, as shown here, there are several projecting parts 13—for example 6—distributed over the periphery of the tooth-set carrier 7, then only a slight turn is needed after placement of the tooth-set carrier 7 until the projecting parts 13 lie over the recesses 14.

In accordance with the exemplary embodiment depicted in FIG. 2, the catch shoulder 12 is arranged on an end piece located opposite the front part 15 of the tooth-set carrier 7. This is especially advantageous for the manufacturing of the catch shoulders 12, since the catch shoulders 12 can then be easily worked out by turning the tooth-set carrier 7. In the embodiment shown in FIG. 2, the catch shoulder 12 is easily formed by a relief in the projecting part 13. The tooth-set carrier 7 is preferably an extruded part made from aluminum material. The tooth set 9 can be placed on top of the tooth-set carrier 7 by inserting a tooth-set wire in the grooves 10 of the tooth-set carrier 7 and caulking it therein by clinching a web among the grooves. Due to the rather tough properties of an extruded part, clinching is feasible. As a result, the tooth set 9 can be fastened in the groove 10 without leaving a gap, thus preventing fibers from jamming. In addition, the core piece is cavity-free.

However, it is also possible to execute the tooth-set carrier 7 as a die-cast piece, in which case the projecting parts 13 can be molded as well. The tooth-set carrier 7 can also be manufactured as a forged piece made from aluminum or brass. A tooth-set carrier 7 made from plastic is also feasible. In that embodiment, it would be advantageous to execute the tooth-set carrier 7 in two parts, including a tooth-set holder 19 and a tooth-set ring 20. In this embodiment only the tooth-set holder 19 would be made of plastic.

The mounted clip elements 11 (see FIG. 1) are propped on the catch shoulder 12 of the tooth-set carrier 7 and secure the tooth-set carrier 7 on the core piece 2 in the axial direction. In the embodiment shown in FIG. 1, the clip element 11 is attached to the core piece like a spring. Preferably, the core piece 2 should be made of plastic material for economical manufacturing. It would be especially advantageous for the core piece to be executed as a plastic injection molded piece. In that embodiment, the clip elements 11 can be injected as one piece with the core piece 2 in a particularly advantageous manner.

Additionally, the manufacturing of the core piece 2 as plastic injection molded piece makes it easy for it to have more complex design features, such as certain indentations for air circulation (not shown here) that do not need subsequent machining. Furthermore, such plastic injection molded pieces can be manufactured with consistent high quality, thus reducing expenses caused by rejected parts and subsequent machining. It is better for the clip elements 11 to be arranged in a relief 16 of the cylindrical external area of the core piece 2, as can be seen, for example, in FIG. 5.

Figure 5:
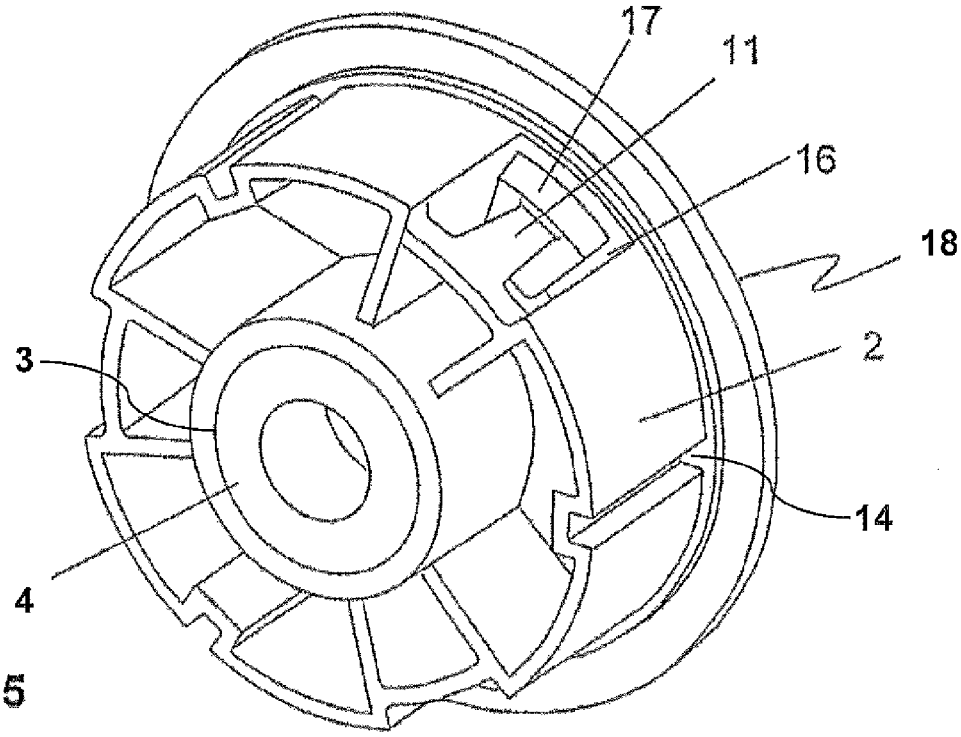
FIG. 5 depicts a perspective view of a core piece according to an exemplary embodiment of the present invention.

FIG. 5 shows a perspective view of a core piece 2 of an opening cylinder 2 according to an exemplary embodiment the present invention that acts together with the tooth-set carrier 7 of FIG. 2. In order to have a form-fitting connection with the tooth-set carrier 7 in the circumferential direction, the core piece 2 has recesses 14 that act together with the corresponding projecting parts 13 of the tooth-set carrier 7 for torque transfer. The core piece 2 shown in FIG. 5 has three recesses 14 for the form-fitting connection in the circumferential direction and three additional reliefs 16 in which the clip elements 11 for the clip connection 8 are arranged in the axial direction. The recesses 14 and reliefs 16 are arranged in the circumferential direction on the core piece 2 and are displaced with regard to one another. Here, the reliefs 16 for the clip elements 11 have been made wider than the recesses 14 for transferring the torque.

It is also possible for the reliefs 16 to be the recesses 14 for the device that enables the form-fitting connection in the circumferential direction and therefore the reliefs 16 and the recesses 14 would have the same width, as shown in FIG. 4.

FIG. 4 shows a sectional view of an opening cylinder according to an exemplary embodiment of the present the invention that has a core piece 2 and a tooth-set carrier 7. The core piece 2 has three recesses 14 evenly distributed in the circumferential direction that act together with the equally wide projecting parts 13 of the tooth-set carrier 7 in the circumferential direction. At the same time, the core piece 2 has clip elements 11 arranged in the recess 14 of the core piece 2. In the embodiment shown in FIG. 4, three clip connections 8 are distributed on the periphery, but it is also equally possible to have only one clip connection 8 or several clip connections 8.

In the embodiments shown in the previous figures, the clip element 11 is arranged on the core piece 2 and the catch shoulder 12 is arranged on the tooth-set carrier 7. It is also possible to arrange the catch shoulder 12 on the core piece 2 and the clip elements 11 on the tooth-set carrier 7. However, this is not practical for manufacturing reasons. Furthermore, it is also possible to deviate from the embodiments shown in the Figures and place the recesses 14 for the form-fitting connection in the circumferential direction on the tooth-set carrier 7 and the corresponding projecting parts 13 on the core piece 2. However, it is especially advantageous to provide one or more clip elements 11 on the core piece 2 because the core piece 2 is preferably made as a plastic injection molded part with the clip element possibly being made as one piece with the core piece 2. It is also possible, however, to manufacture a clip element 11 separately and to fasten it to the core piece or tooth-set carrier 7.

FIG. 6 shows a detailed view of a clip element 11 formed by a leaf spring 22 that in this embodiment has been screwed in the core piece 2 of an opening cylinder 1. Needless to say, instead of a screw joint, a welded joint, riveted joint or the like can also be utilized.

Figure 9:
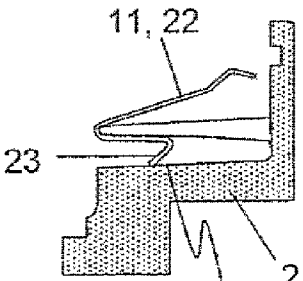
FIG. 9 depicts a detailed view of the fastening of a leaf spring clip.

FIG. 9 shows the fastening of a clip element 11 formed by a leaf spring 22 with a shaped clamping element 23. In the embodiment shown in FIG. 9, the end piece of the leaf spring 22 has been bent to an acute angle as clamping element 23. For mounting purposes, the leaf spring 22 is pushed over a correspondingly shaped seat 24 of the core piece 2 so that the bent end piece of the leaf spring expands against the wall 25 of the core piece 2 and interlocks with it. As can also be seen in FIG. 9, the end piece has been bent in such a way that the clamping element 23 gives way in a spring-like manner in the direction of mounting. However, the clamping element 23 interlocks with the wall 25 in the dismounting direction, thereby fixing the clip element 11 in position. Thus, dismounting of the clip element 11 can only be performed with a tool that lifts the clamping element 23 off the wall 25.

Figure 10:
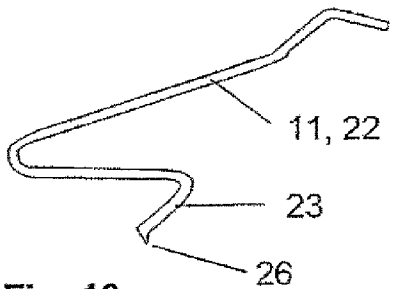
FIG. 10 depicts a detailed view of a clamping element for fastening a leaf spring clip.

It is particularly advantageous for the clamping element 23 to have an edge 26 to support the interlocking process, as shown in FIG. 10. Preferably, the clip element 11 is manufactured from spring band steel by having a piece cut into longitudinal sections for bending. If a punching process is used for cutting the band into longitudinal sections, then the resulting cut piece will have such an advantageous edge 26. When bending the spring band steel to the clip element 11, one must only take notice of the correct orientation of the edge 26.

Figure 11:
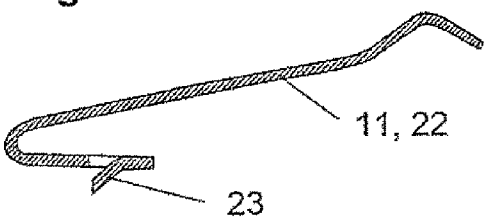
FIG. 11 depicts a detailed view of another clamping element.

FIG. 11 shows another exemplary embodiment of the clamping element 23. Here, the clip element 11 or the leaf spring 22 is shown in a diagrammatic sectional view. The clamping element 23 has a window that has been punched out from the spring band steel that will eventually also be bent towards the wall. This design has the advantage that the clamping element 23 will need less space relative to the bent end piece clamping element.

It is especially advantageous for the clamping element 23 to be made from plastic, but all other materials considered (aluminum, for example) provide sufficient retention force. Naturally, the clip element 11 can be fastened not only to the core piece 2 but to the tooth-set carrier 7 as well.

FIG. 5 depicts an alternate embodiment of the clip elements 11. As can be seen in FIG. 5, the end piece 17 has an extension running radially inwards to increase the mass of the end piece 17. Likewise, the end piece 17 of the clip element 11 has been executed a great deal wider. As a result of this, the mass of the end piece 17 that acts together with the catch shoulder 12 can be increased so much that the retention force of the clip connection is increased during rotation. This embodiment of the clip element 11 can also be seen in FIG. 3, which shows the sectional view of an opening cylinder 1 according to an exemplary embodiment of the present invention.

As already described with respect to FIG. 1, a press fit fastens the core piece 2 with its seat 3 to a shaft 4. A clip connection 8 fixes the tooth-set carrier 7 to the core piece 2 in the axial direction. To accomplish this, the core piece 2 has clip elements 11 with expanded end pieces 17 as described above that act together with the catch shoulder 12 of the tooth-set carrier 7. The embodiment of the clip elements in accordance with FIGS. 3 and 5 allows the doubling of the axial retention forces compared to the clip element seen in FIG. 1.

Figure 3:
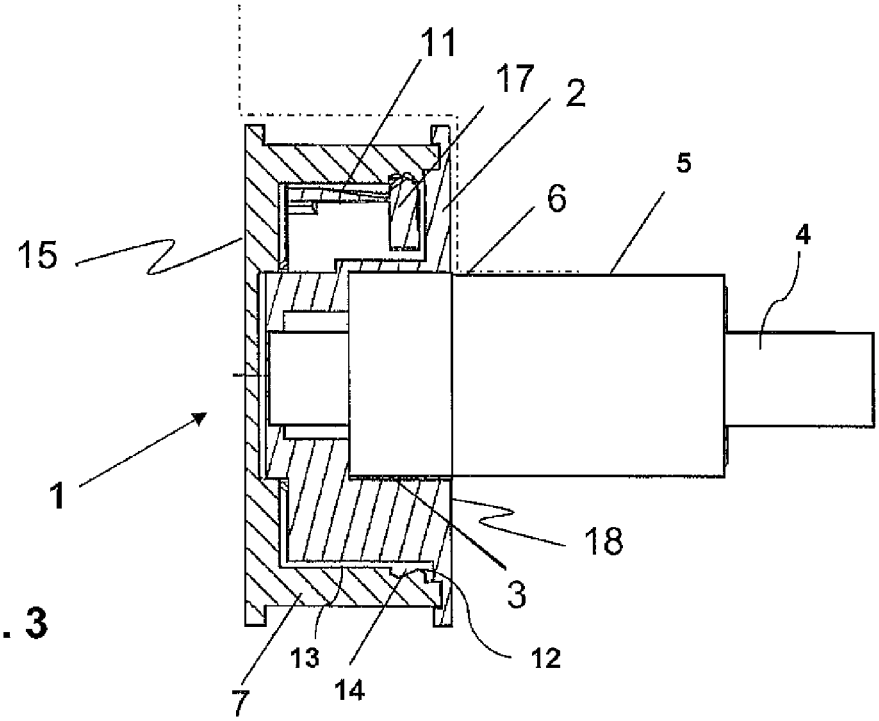
FIG. 3 depicts a sectional view of the tooth-set carrier shown in FIG. 2 with an opening cylinder according to an exemplary embodiment of the present invention.

FIG. 3 also shows that the shaft 4 can remain together with the core piece 2 in the open-end spinning device 6 (indicated by a dash-dot line). To replace the tooth-set carrier 7, one can simply detach it radially outwards from the core piece. In the embodiment shown in FIG. 3, the front part 18 of the mounted core piece 2 is oriented towards the inside of the open-end spinning device 6.

It is also possible to execute the core piece 2 so that its front part points outwards, as shown in FIG. 1. In this embodiment, when the tooth-set carrier 7 along with the tooth set needs to be replaced, the entire opening cylinder 1 must be taken out of the spinning device 6 with the shaft 4 so the tooth-set carrier 7 can be detached from the core piece 2 by moving it in the axial direction over the top of the bearing 5.

Figure 12:
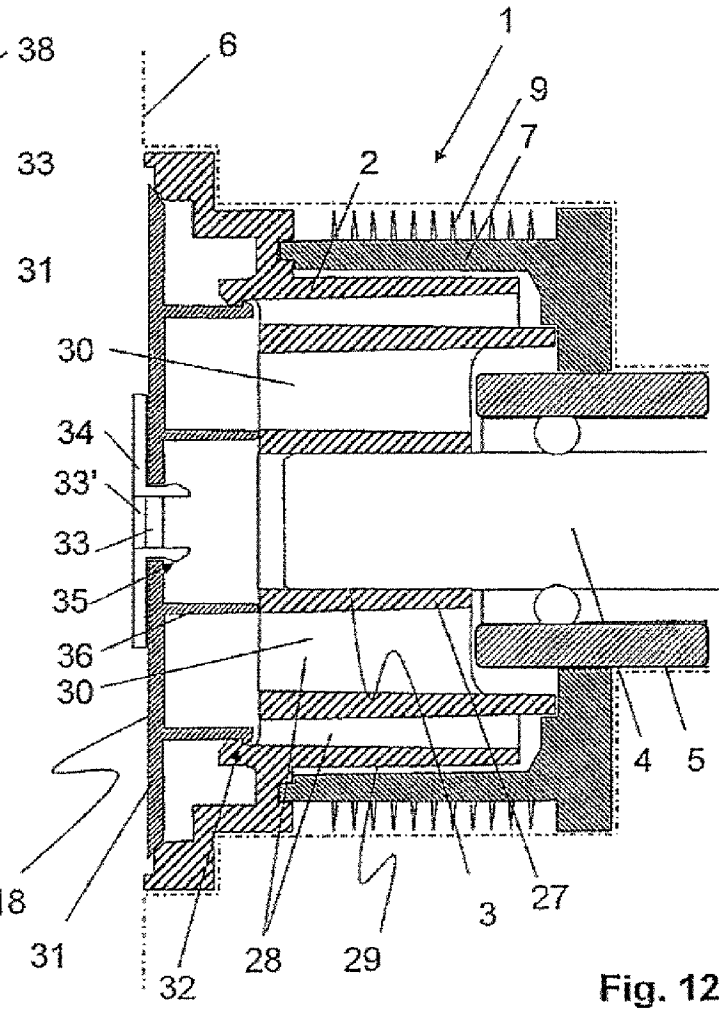
FIG. 12 depicts a diagrammatic sectional view of an opening cylinder with a lid and an identification carrier.

FIG. 12 shows an opening cylinder 1 that also must be taken out of the spinning device 6 together with the shaft 4. Contrary to the embodiment shown in FIG. 1, the core piece 2 has been optimized—its walls are thinner and its mass low. Thus, the core piece 2, made in this embodiment from a plastic injection molded part, consists of a hub 27 for fastening to the shaft 4. The hub 27 is only connected to the outer periphery of the core piece 2 with webs 28. Here, the webs 28 are shown running axially, but radially-running webs 28 are also possible.

In the embodiment shown in FIG. 12, the core piece 2 has axially-running grooves 30 known from the current state of the art. These grooves 30 enable the construction of the core piece 2 as light weight and thin-walled as possible. However core-pieces of this construction have problems because dirt can accumulate in the grooves 30 and cannot be removed easily. To address this problem, the embodiment shown in FIG. 12 provides grooves 30 that largely run through the entire core piece 2 and therefore open up towards the front and back. The grooves 30 are also arranged to provide accessibility to the grooves 30 when the core piece 2 is mounted on the shaft 4.

As shown in FIG. 12, the front part 18 of the core piece 2 includes a detachable lid 31. Once the lid 31 is detached, it is possible to clean the grooves 30. If the opening cylinder 1 is taken out of the spinning device 6, then cleaning can also take place (with pressurized air, for example) from the bearing side after removal of the tooth-set carrier 7. This is especially advantageous because dirt accumulates very frequently between the bearing 5 and the core piece 2, and it is almost impossible to remove the dirt from the bearing side.

Since the front part 18 of the core piece 2 is formed by a lid 31, the core piece 2 as a whole can be made with very thin walls and is light weight. The core piece 2 has several steps 32 on its outwards-pointing end that form a labyrinth seal with the corresponding contour of the open-end spinning device 6. Consequently, the opening range of the opening cylinder 1 is well sealed towards the exterior. The interior of the lid 31 has a lug 36 propped against the hub 27 of the core piece 2, thus sealing off the interior of core piece 2 to prevent unfavorable air currents in the interior and the intake of air from the exterior.

The lid 31 is preferably detachable from the core piece 2 to facilitate cleaning as described above. In addition, the lid 31 can also provide information about the tooth set 9. When the tooth set 9 is replaced, the lid 31 can be replaced with a corresponding lid 31 for the new tooth set 9. Therefore, it is recommended to fasten the lid 31 to the core piece 2 in such a way to allow easy removal.

In the illustration shown in FIG. 12, the lid 31 has been fastened to the core piece 2 with a catching device 32. The lid 31 is consequently detachable for cleaning purposes. The lid 31 has an opening 33 so the opening cylinder 1 can be dismounted from the spinning device 6. A tool can be introduced through this opening 33 for removing the entire opening cylinder 1 together with the shaft 4. The retention forces of the catching device 32 must consequently be larger than the dismounting forces of the entire opening cylinder 1. Therefore, the catching device 32 must have a greater retention force, counteracting the desired easy removal of the lid 31.

So that it is possible to provide externally visible and easily replaceable information about the used tooth set 9, an easily detachable identification carrier 34 has been assigned to the lid 31. The identification carrier 34 will have information about the current tooth set so that it can also be easily identifiable from the outside. According to the embodiment shown in FIG. 12, the identification carrier 34 has been fastened to the opening 33 with a clip device 35 with low retention force so the identification carrier 34 can be disassembled with a dismounting tool. The identification carrier 34 also has an opening 33', located directly above the opening 33. It is also possible to fasten the identification carrier 34 by plugging it into the opening 33 without a catching element so that the identification carrier 34 is held only by friction. Information about the current tooth set 9 has been imprinted on the outwards-pointing side of the identification carrier 34.

Figure 13:
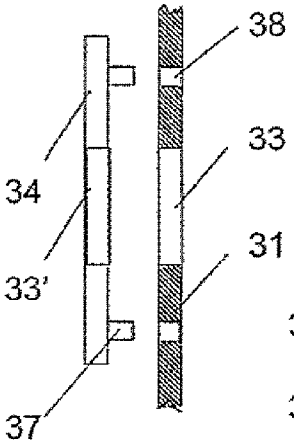
FIG. 13 depicts a diagrammatic view of the fastening of an identification carrier.

FIG. 13 shows a diagrammatic view of an identification carrier 34 fastened to the corresponding bore holes 38 of the lid 31 with the help of pin-shaped protrusions 37. The identification carrier 34 consequently is fastened purely by friction.

As can be seen in FIG. 5, it is additionally advantageous for the core piece 2 to have a seat 3 made of cast-in metal (aluminum or brass, for example). As a result, no special materials are needed for the plastic of the core piece 2 and the core piece 2 could still be fastened to the shaft 4 by a press fit in the way already described. Likewise, it is also possible to select a certain plastic that would allow a press connection with the shaft 4.

If the core piece 2 is made of plastic material, then it would also be advantageous for the plastic material to conduct electricity because it may prevent the charging of the opening cylinder 1 and unfavorable fiber adhesions.

FIG. 7 shows a longitudinal section of an opening cylinder according to an exemplary embodiment of the present invention that is similar to the embodiment shown in FIG. 1. In this embodiment, the opening cylinder has a two-part tooth-set carrier. The two parts of the tooth-set carrier 7 comprise a tooth-set holder 19 and a tooth-set ring 20 in which a tooth set 9 made of teeth or needles has been incorporated. To allow a torque transfer to the tooth-set ring 20, a device for the radial catching 21 of the tooth-set ring 20 is utilized. As can be seen in FIG. 8, the radial catching 21 can consist of a projecting part and a recess that form a form-fitting connection in the circumferential direction. In this embodiment, the projecting part is arranged in the tooth-set holder 19 and the recess is arranged in the tooth-set ring 20. However, the projecting part and recess can also be arranged the other way around.

The two-part embodiment of the tooth-set carrier 7 with a tooth-set holder 19 and a tooth-set ring 20 also makes it possible to manufacture the tooth-set holder economically from a plastic material. Only the tooth-set ring 20 that supports the tooth set 9 must be made of metal. Thus, the opening cylinder 1 can be manufactured cheaply. Furthermore, if the tooth set 9 wears out, only the tooth-set ring 20 must be replaced.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. An opening cylinder for an open-end spinning device, the opening cylinder defining an axial direction, a radial direction, and a circumferential direction, the opening cylinder comprising:

a core piece, the core piece further comprising a seat configured to connect the opening cylinder to a drive shaft;

a tooth set carrier being fastened to the core piece in the axial direction by a clip connection; the clip connection comprising a flexible clip element configured to elastically bend in the radial direction and a catch shoulder for engagement with the clip element;

the tooth set carrier being fastened to the core piece in the circumferential direction by a form-fitting connection; the form-fitting connection comprising a radially extending projecting part on one of the tooth set carrier or core piece and a recess in the other of the tooth set carrier or core piece in which the projecting part engages for transmitting rotational torque from the core piece to the tooth set carrier; and wherein the catch-shoulder of the clip connection is defined on the projecting part of the form-fitting connection.

2. The opening cylinder of claim 1, wherein the projecting part of the clip connection extends along the axial direction of the core piece.

3. The opening cylinder of claim 1, wherein the tooth set carrier defines an inner surface, the projecting part being located on the inner surface of the tooth-set carrier and the recess being located on the core piece.

4. The opening cylinder of claim 3, wherein the tooth set carrier has a plurality of the projecting parts evenly circumferentially distributed on the inner surface of the tooth set carrier.

5. The opening cylinder of claim 1, wherein the tooth-set carrier defines a front part and an opposing end part, the catch shoulder of the clip element being located on the end part of the tooth set carrier.

6. The opening cylinder of claim 5, wherein the front part and the end part of the tooth set carrier each define a diameter, the diameter of the end part being less than the diameter of the front part.

7. The opening cylinder of claim 1, wherein the core piece comprises an outer surface and a relief located on the outer surface, the relief being separate from and circumferentially spaced from the recess of the form-fitting connection, the clip element being located in the relief.

8. The opening cylinder of claim 7, wherein the core piece defines an outer surface, the core piece comprising a plurality of the clip elements that are uniformly arranged around the outer surface, each of the clip elements being individually located in individual ones of the reliefs.

9. The opening cylinder of claim 1, wherein the core piece and the clip element are formed as one piece.

10. The opening cylinder of claim 1, wherein the clip element is a leaf spring connected to the core piece.

11. The opening cylinder of claim 10, wherein the leaf spring comprises a clamping element that engages the core piece.

12. The opening cylinder of claim 1, wherein the clip element comprises an end piece that engages the catch shoulder, the end piece extending radially inward from an end of the clip element and having a wider width than the end of the clip element, thereby having an increased mass that increases the retention force of the clip connection during rotation.

13. The opening cylinder of claim 1, wherein the core piece is formed of a plastic material.

14. The opening cylinder of claim 1, wherein the core piece further comprises a metallic seat cast for attaching the opening cylinder to a drive shaft.

15. The opening cylinder of claim 1, wherein the core piece defines a front part and an opposing end part, the front part of the core piece being oriented away from an end of the core piece that attached to a drive shaft of the open-end spinning device.

16. The opening cylinder of claim 15, wherein the front part of the core piece comprises a detachable lid.

17. The opening cylinder of claim 16, wherein the detachable lid further comprises a replaceable identification carrier.

18. The opening cylinder of claim 15, wherein the core piece further comprises grooves running in the axial direction from the front part of the core piece to the end part of the core piece, the grooves being accessible from both the front part of the core piece and the end part of the core piece.

* * * * *